US008783493B2

(12) United States Patent
Lucas et al.

(10) Patent No.: US 8,783,493 B2
(45) Date of Patent: Jul. 22, 2014

(54) PACKAGE PROVIDED WITH A LEAKTIGHT OPENING AND CLOSING DEVICE

(75) Inventors: Franck Lucas, Gergy (FR); Philippe Lutringer, Paris (FR); Michel Laville, Damerey (FR)

(73) Assignee: 3L Distribution, Champforgeuil (FR)

( * ) Notice: Subject to any disclaimer, the term of this patent is extended or adjusted under 35 U.S.C. 154(b) by 536 days.

(21) Appl. No.: 13/120,405

(22) PCT Filed: Sep. 18, 2009

(86) PCT No.: PCT/FR2009/051763

§ 371 (c)(1), (2), (4) Date: Jun. 10, 2011

(87) PCT Pub. No.: WO2010/031975

PCT Pub. Date: Mar. 25, 2010

(65) Prior Publication Data

US 2012/0103987 A1 May 3, 2012

(30) Foreign Application Priority Data

Sep. 22, 2008 (FR) ..... 08 05175
Feb. 23, 2009 (FR) ..... 09 00799
Jun. 12, 2009 (FR) ..... 09 53920

(51) Int. Cl.
*B65D 51/18* (2006.01)

(52) U.S. Cl.
CPC ..... *B65D 51/18* (2013.01); *B65D 2543/00046* (2013.01); *B65D 2543/00296* (2013.01)
USPC ..... 220/254.3; 220/254.9; 215/228

(58) Field of Classification Search
USPC ..... 220/254.3, 254, 254.1, 254.7, 254.9, 220/260, 265, 266; 215/228, 250
See application file for complete search history.

(56) References Cited

U.S. PATENT DOCUMENTS 7,473,399 B2 * 1/2009 Dehmer ..... 422/547
2004/0159665 A1 8/2004 Morrissey
(Continued)

FOREIGN PATENT DOCUMENTS

FR 2170298 9/1973

*Primary Examiner* — Robert J Hicks
*Assistant Examiner* — Kareen Rush
(74) *Attorney, Agent, or Firm* — Morris & Kamlay LLP

(57) ABSTRACT

The invention relates to the field of packages of consumable product provided with a substantially plane wall (15) and fitted with an orifice (13). A package is equipped with an opening and closing device (1) comprising a body (2) in a single piece, made of molded material, fixed on the wall (15), this body (2) comprising a plate (20) fitted with a hole (30) placed opposite the orifice (13) and fixed on the edge (19) of the orifice (13) of the wall (15) in a leaktight manner, and a door (40) articulated to this plate (20) opening towards the interior of the package and capable of blocking this hole (30) in a leaktight manner, and in that it further comprises an arm (50) connected to the door (40), the arm (50) cooperating with blocking means in a position such that it keeps the door (40) in a leaktight blocking position, and releasing the door (40) in pivoting towards the interior of the package when it is disengaged from the blocking means, and in that it further comprises a cover (80) distinct from the body (2) and from the arm (50), and which is fitted with a safety disc (100, 104) which must be broken during initial opening of the door (40), such that if the safety disc is intact, it is guaranteed that the package has never been opened previously, the disc forming part of the blocking means.

14 Claims, 6 Drawing Sheets

(56) References Cited

U.S. PATENT DOCUMENTS

Figure 1:
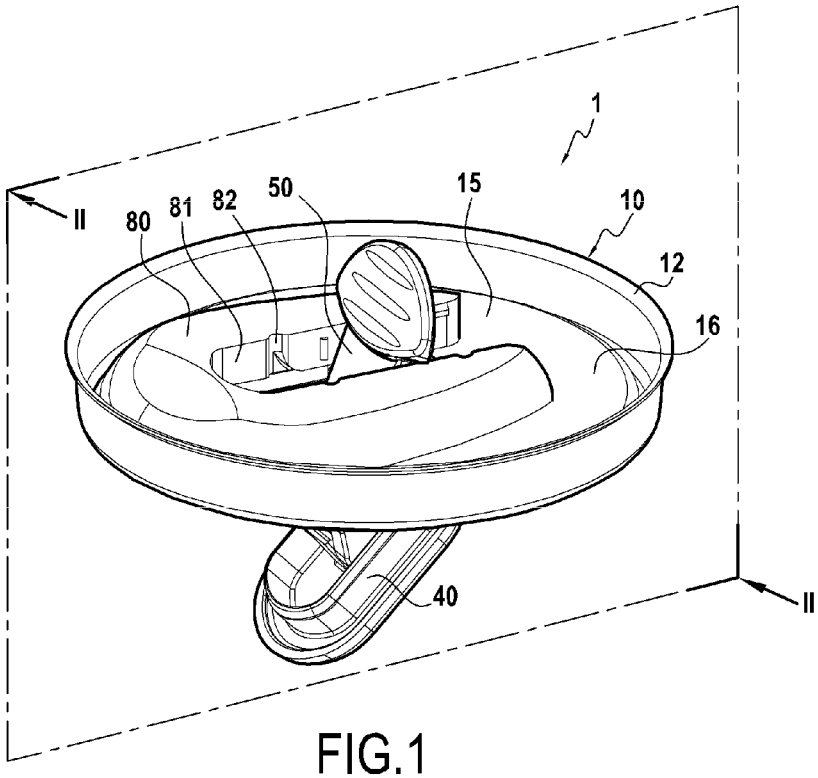

2007/0068943 A1* 3/2007 Ramsey et al. ..... 220/254.3
2007/0164026 A1* 7/2007 Morrissey et al. ..... 220/254.3
2007/0262079 A1* 11/2007 Paris et al. ..... 220/254.4
2008/0110887 A1* 5/2008 Ramsey et al. ..... 220/254.3
2013/0062358 A1* 3/2013 El-Saden et al. ..... 220/715

* cited by examiner

PACKAGE PROVIDED WITH A LEAKTIGHT OPENING AND CLOSING DEVICE

The present invention relates to a package of consumable product provided with a substantially plane wall and fitted with an orifice. It relates more particularly to an opening and closing device of such a package.

This package is for example a metal can, which designates a substantially cylindrical container, most often made of double-reduction steel or aluminium, designed to contain a consumable product such as liquid drink. In the following description the terms "interior" and "exterior" designate respectively the parts of a piece directed towards or located inside the package, and directed towards or located outside the package. A metal can is used as an example of a package for the prior art and the invention. A liquid drink is used as an example of a consumable product.

The lower end of the metal can is closed, and its upper face is a cup whereof the plane part comprises a disc, and a tongue which is attached to the cup by an attachment point located in the vicinity of the disc. Via a lever movement relative to this attachment point this tongue presses on the disc so as to tear off a precutout part of the periphery of the disc. As it is being torn off, the disc creates an orifice via which the liquid contained in the metal can can flow out, for example to be consumed. Thus the disc is folded back inside the metal can, held attached to the cup by the non-torn part of its periphery.

The disadvantage of such a metal can is that it cannot be reclosed once opened. The liquid can thus escape from the metal can if it is tipped upside down. Foreign bodies (insects, dust) can also contaminate the liquid by entering via the orifice of the cup. Also, if the liquid is gaseous, there is no more gas present in the drink after a few hours. These disadvantages especially obligate the user to consume the entire contents of the metal can shortly after it has been opened.

Plastic covers which close over the rim of the cup are known. However, this cover lets the liquid escape from the metal can in the space between the cup and this cover, which is inconvenient when the cover is opened. Also, such a cover is not sufficiently leaktight, as the pressure of the gas tends to separate the cover from the cup.

A rotary cover such as described in US 2009/032531 is also known. This plastic cover closes over part of the rim of the metal can and is flattened against the upper face of the cup, and is capable of pivoting about the axis of the metal can so as to cover or uncover the orifice created by the opening of the disc. However, neither is such a cover sufficiently leaktight.

The invention aims to propose a package equipped with an opening and closing device which opens and readily recloses this package, which is perfectly leaktight and can easily be handled by the user.

This aim is attained because of the fact that the package of consumable product, which is provided with a substantially plane wall and fitted with an orifice, is equipped with an opening and closing device comprising a body in a single piece, made of moulded material, fixed on said wall, said body comprising a plate fitted with a hole placed opposite to said orifice and fixed on the edge of said orifice of the wall in a leaktight manner, and a door articulated to this plate opening towards the interior of the package and capable of blocking this hole in a leaktight manner, in that it further comprises an arm connected to said door, said arm cooperating with blocking means in a position such that it keeps said door in a leaktight blocking position, and releasing said door in pivoting towards the interior of said package when it is disengaged from said blocking means, and in that it further comprises a cover (80) distinct from said body (2) and from said arm (50), and which is fitted with a safety disc (100, 104) which must be broken during initial opening of said door (40), such that if said safety disc is intact it is guaranteed that the package has never been opened previously, said disc forming part of said blocking means.

Because of these arrangements, the package can be opened, reclosed and reopened as many times as wanted. The fact that the arm is kept blocked in the closed position by blocking means also locks the door in a leaktight manner.

Advantageously, the plate is fixed on the edge of the orifice of the wall by snap-locking.

Thus, adapting and fixing the device on the wall is particularly easy, and the sealing is reinforced.

Advantageously, the plate is supported essentially on the inner face of the wall.

Given that the door opens towards the interior of the package, any gases possibly present inside the package tend to further press this door against the inner face of the plate of the body of the device when the door is in the closed position, which contributes to ensuring the sealing of the package, and thus preventing these gases from escaping.

Figure 2:
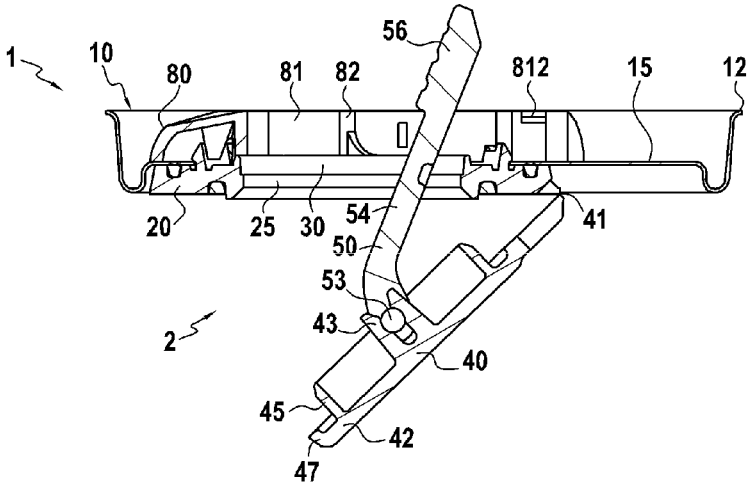
Figure 3:
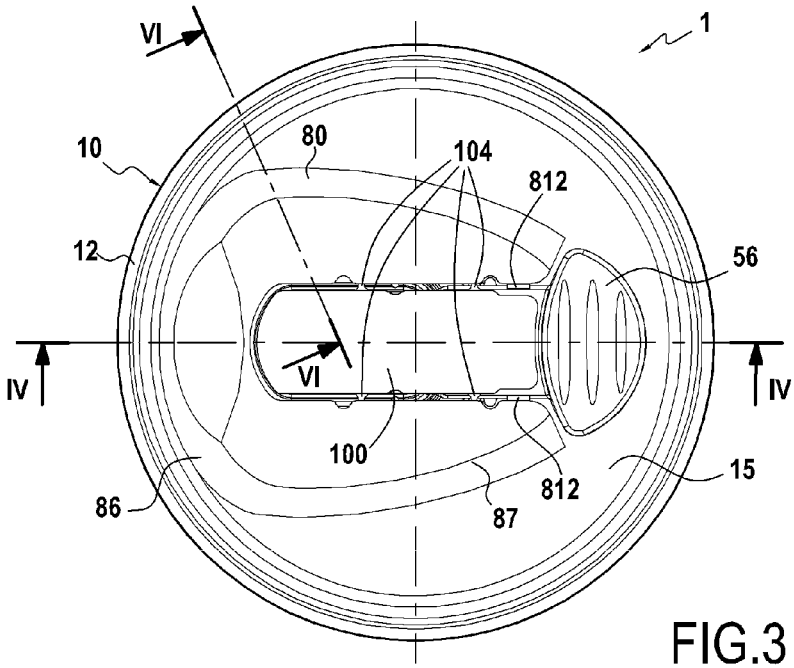
Figure 4:
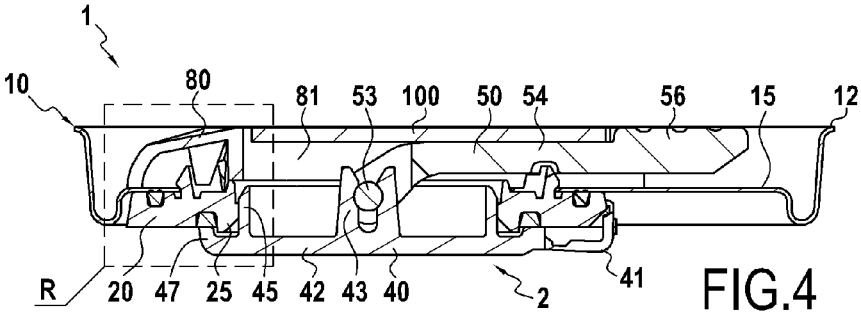
Figure 5:
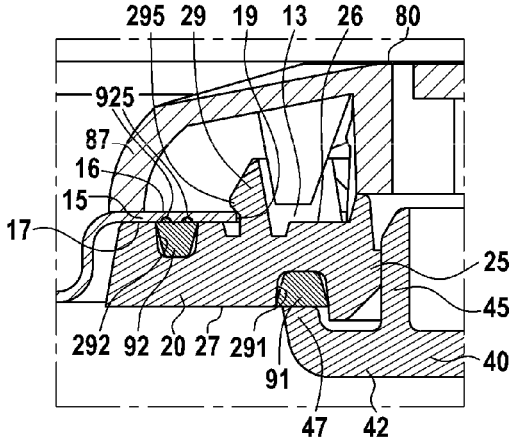
Figure 6:
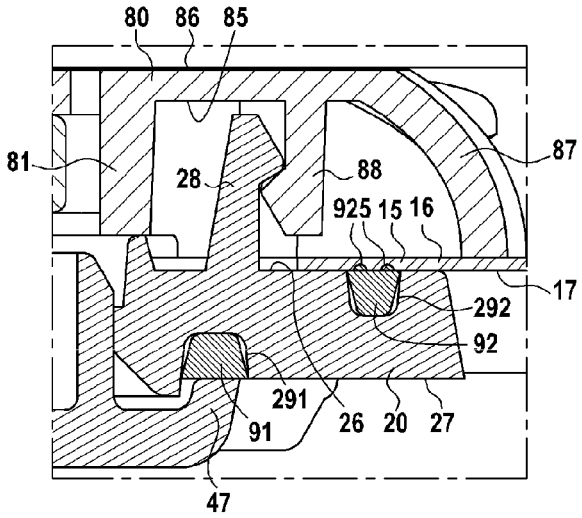
Figure 7:
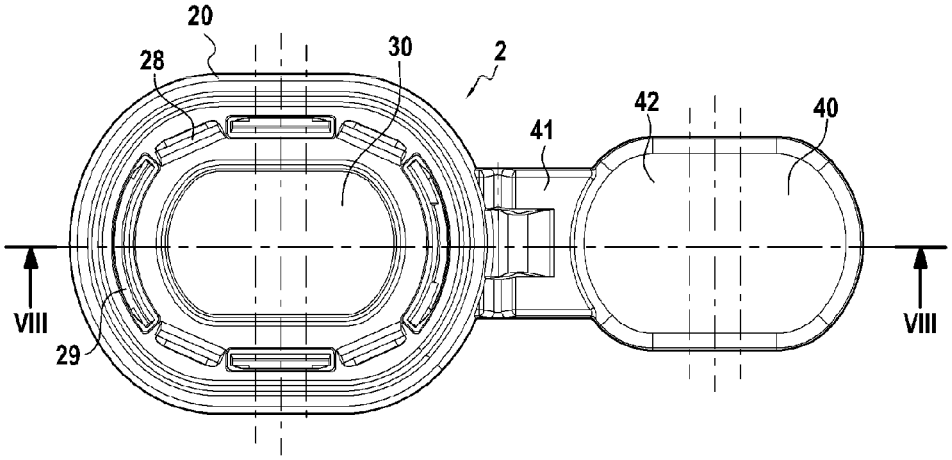
Figure 8:
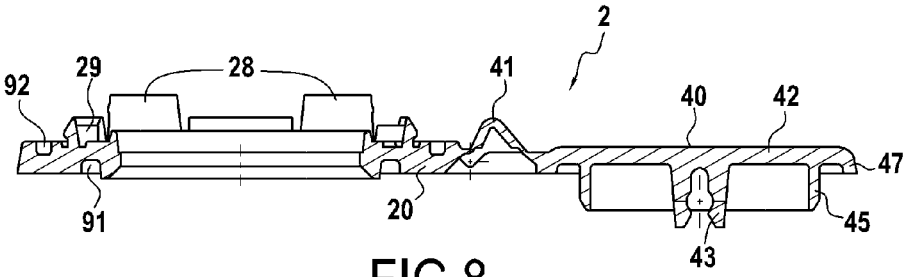
Figure 9:
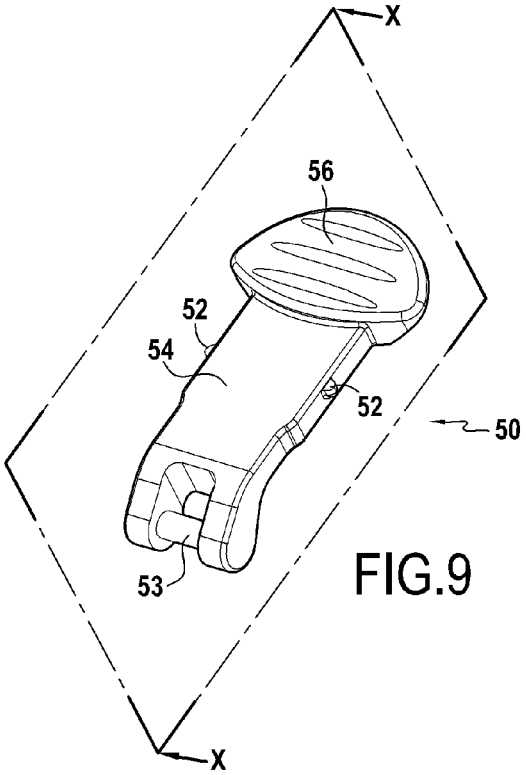
Figure 10:
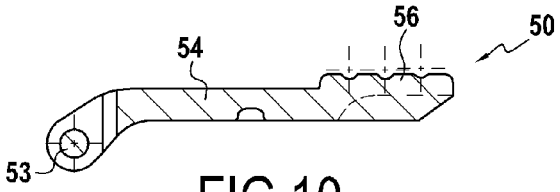
Figure 11:
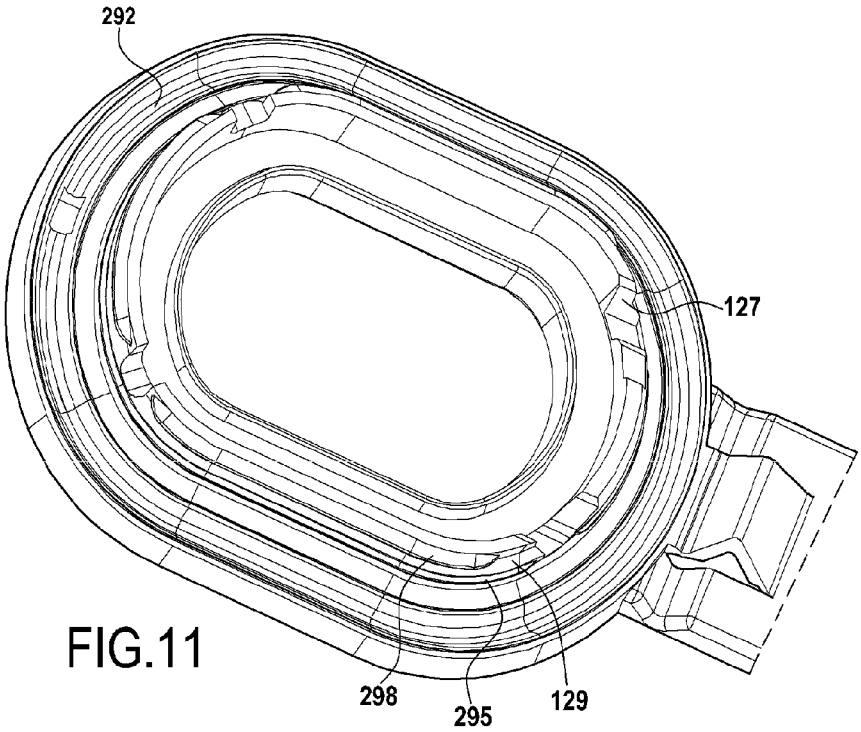
Figure 12:
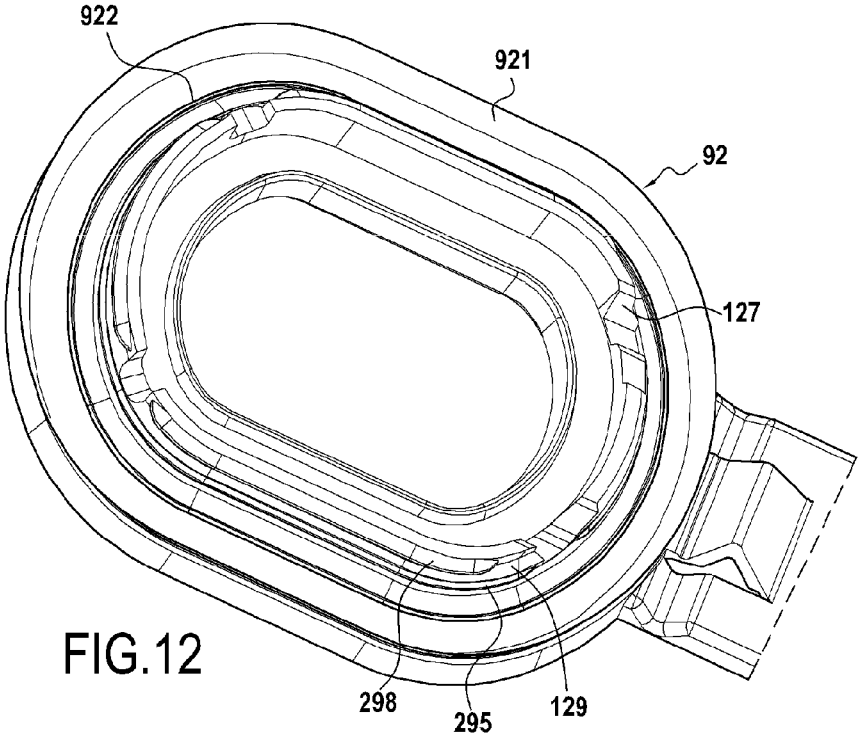
Figure 13:
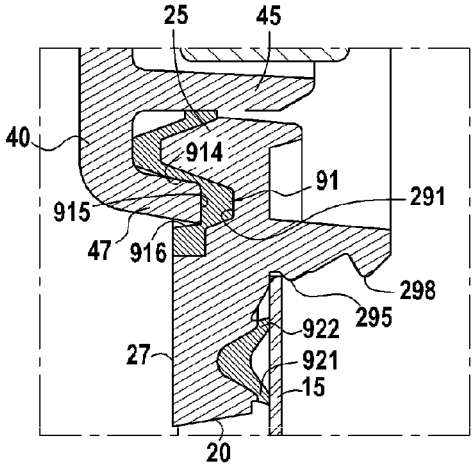
Figure 14:
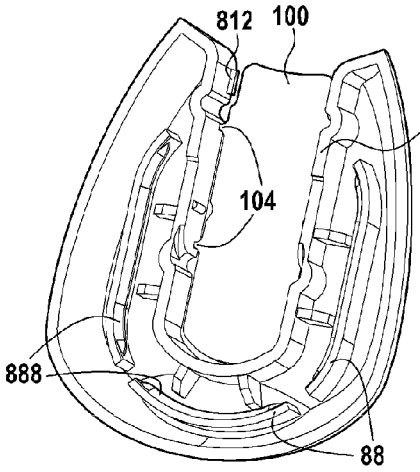
Figure 15:
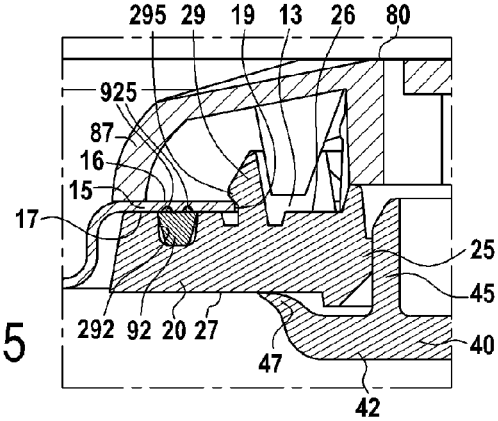

The invention will be better understood and its advantages will emerge more clearly from the following detailed description of an embodiment illustrated by way of non-limiting example. The description refers to the attached diagrams, in which:

FIG. 1 is a perspective view of the part of a package (cup) according to the invention showing the opening and closing device, the door being in the open position, FIG. 2 is a sectional view of the cup and of the opening and closing device according to the line II-II of FIG. 1, FIG. 3 is a plan view of the cup and of the opening and closing device, the door being in the closed position, FIG. 4 is a sectional view of the cup and of the opening and closing device according to the line IV-IV of FIG. 3, FIG. 5 is an enlarged view of the region R of FIG. 4 illustrating the snap-lock mechanism of the opening and closing device on the cup, FIG. 6 is an enlarged view of a section of the device according to the line VI-VI of FIG. 3, illustrating the snap-lock mechanism of the cover on the plate, FIG. 7 is a plan view of the body of the opening and closing device, FIG. 8 is a sectional view of the body according to the line VIII-VIII of FIG. 7, FIG. 9 is a perspective view of the arm of the opening and closing device, FIG. 10 is a sectional view of the arm according to the line X-X of FIG. 9, FIG. 11 is a perspective view of the body of the opening and closing device according to a variant of the invention, FIG. 12 is a perspective view of the body and of a joint of the opening and closing device according to a variant of the invention, FIG. 13 is a sectional view of part of the opening and closing device according to a variant of the invention, illustrating the snap-lock mechanism of the body on the cup and of the body with the cover, FIG. 14 is a perspective view of the cover according to a variant of the invention, FIG. 15 is a view similar to FIG. 5 illustrating a different configuration of the sealing joint between the door and the body of the device according to the invention.

The invention is described hereinbelow in reference to a metal can. However, any package provided with a substantially plane wall and fitted with an orifice can be the object of the present invention.

FIGS. 1 to 4 show the opening and closing device 1 according to the invention mounted on a cup 10 of a metal can (not shown). The cup 10 is substantially circular, with a plane wall 15 enclosed by a peripheral rim 12. The peripheral rim 12 of the cup is for example identical to the rim of a standard cup of a metal can, such that the cup 10, once fitted with the device 1, can be mounted during manufacture on any metal can. The plane wall 15 of the cup 10 has an orifice 13 delimited by an inner edge 19. The orifice 13 has an oblong form and extends radially from the centre of the cup to near the rim 12.

FIG. 1 and the FIG. 2 show the device 1 in a partially open position. The device 1 comprises a body 2 which comprises a plate 20 which has in its centre a hole 30 delimited by an edge 25 of the plate 20. The body 2 is also illustrated in FIGS. 7 and 8. The body 2 also comprises a door 40, the body 2 being in a single piece, that is, the door 40 forms a continuous assembly with the plate 20. Thus, the body 2 is made by moulding in monobloc, which is an industrial solution which is faster and less expensive than if the door 40 were made separately from the plate 20. The body 2 is made of polymer, for instance.

The door 40 is articulated to the plate 20 by a moulded supple web 41, located on the circumference of the plate 20. The web 41 accordingly forms a hinge. The door 40 comprises a base 42 of periphery 47, at the centre of which is mounted a cylindrical wall 45.

When the door 40 is in the open position, it is lodged inside the metal can.

FIG. 4 shows the door 40 in the closed position. The web 41 is completely folded back. The radially external face of the cylindrical wall 45 closes over the radially internal face of the edge 25 of the plate 20, such that the cylindrical wall 45 substantially fits without clearance in the hole 30. Thus, this produces a sealing which contributes to preventing the liquid contained in the metal can from flowing out.

FIG. 5 is an enlargement of part of FIG. 4, detailing the fitting of the door 40 and the plate 20. During this fitting, the periphery 47 of the door 40 is supported on the lower face 27 (directed towards the interior of the metal can) of the plate 20 which encloses the hole 30. In the case shown in the figures, the periphery 47 is actually supported on a first joint 91 lodged in a first groove 291 of the lower face 27. The contact zone between the periphery 47 and the joint 91 fully encloses the hole 30. This produces a sealing between the door 40 and the plate 20 which contributes to preventing the liquid contained in the metal can from escaping to the exterior. Also, when the contents of the metal can are a gaseous liquid, the gas tends to press the door 40 against the plate 20. The pressure exerted by the periphery 47 on the first joint 91 increases, which tends to improve the sealing between the door 40 and the plate 20.

Alternatively, as shown in FIG. 13, which shows part of the plate 20 in section, the first joint 91 covers the first groove 291 as well as the edge 25 of the plate 20 which encloses the hole 30. The first joint 91 extends over the radially internal face of the edge 25 so as to cover, over a portion of its height, the entire periphery of this radially internal face.

The first joint 91 fills the base and sides of the first groove 291 but does not entirely fill the central region of this first groove 291 such that the upper face of the first joint 91 has an annular depression 915 over its entire circumference. This annular depression 915 is bordered radially externally by an external wall 916 of the first joint 91 whereof the apex is substantially flush with the lower face 27, and radially internally by an internal wall 914 which is formed by the part of the first joint 91 covering the edge 25 of the plate 20.

Thus, this annular depression 915 forms a throat in which the periphery 47 of the door 40 lodges, allowing better sealing between the door 40 and the plate 20.

In addition, the annular region of the door 40 located between the cylindrical wall 45 and the periphery 47, and which is opposite the edge 25 of the plate 20 when the door 40 is reclosed, is formed such that it closes over part of the first joint 91 which covers the edge 25 of the plate 20. Thus, the part of the first joint 91 which covers the edge 25 is pinched between the cylindrical wall 45 and the periphery 47 when the cylindrical wall 45 engages in the hole 30, which reinforces the sealing between the door 40 and the plate 20. Also, since the door 40 is in contact with the first joint 91 over a large surface, the door 40 deforms less in torsion under the effect of pressure from the gas contained in the metal can.

The fixing of the plate 20 on the cup 10 is described hereinbelow.

The plate 20 comprises, on its upper face 26, first tabs 29 which are located about the hole 30 and which extend perpendicularly to the upper face 26. The first tabs 29 are located along a layout of forms identical to the orifice 13 and of slightly lesser size, such that when the plate 20 is positioned on the plane wall 15 of the cup 10, the first tabs 29 insert into the orifice 13.

Each one of the first tabs 29 comprises, on its radially most external face, a bead 295 which extends circumferentially along these first tabs 29. The positioning of the first tabs 29 and the thickness (in radial direction) of the beads 295 is such that when these first tabs 29 are forced into the orifice 13, the first tabs 29 deform radially towards the centre of the orifice 13 when the inner edge 19 of the plane wall 15 pushes back the beads 295. Thus, the plate 20 is fixed on the cup 10 by snap-locking by means of the first tabs 29. As illustrated in FIG. 7, the first tabs 29 are distributed on the plate 20 over the entire circumference of the orifice 13 such that this snap-locking is distributed substantially uniformly over this entire circumference. The distance between the upper face 26 (opposite the lower face 27) of the plate 20 and the beads 295 is equal to the thickness of the plane wall 15 such that after this snap-locking the upper face 26 is held supported on the inner face 17 of the plane wall 15 by the beads 295.

Over its entire circumference the upper face 26 comprises a second groove 292 which encloses the first tabs 29.

A second joint 92 is lodged in the second groove 292 of the upper face 26 and a part 925 of this second joint 92 protrudes from the second groove, such that the part 925 comes into contact with the inner face 17 when the plate 20 is fixed on the cup 10. The contact zone between the inner face 17 and the joint 92 which is supported against this face, entirely encloses the orifice 13. This produces a sealing between the wall 15 and the plate 20 which contributes to preventing the liquid contained in the metal can from escaping. In addition, when the contents of the metal can are a gaseous liquid, the gas tends to press the plate 20 against the inner face 17 of the plane wall 15. The pressure exerted by the inner face 17 on the second joint 92 increases, which tends to improve the sealing between the plate 20 and the plane wall 15.

The part 925 of the second joint 92 is for example two circumferential excrescences which extend on the (upper) face of the second joint 92 opposite the inner face 17, as evident in FIGS. 5 and 6. These excrescences are crushed against the inner face 17 when the plate 20 is fixed on the cup 10, ensuring sealing.

Alternatively, as shown in FIG. 12, the second joint 92 can be a ring whereof the transversal cross-section has a substantial V-shape. The ends of the two branches of the V each form a lip (first lip 921 and second lip 922), these two lips making up the part 925 of the second joint 92 which protrudes from the groove 292. The second joint 92 is also evident in FIG. 13.

The groove 292, without the second joint 92, is evident in FIG. 11.

When the plate 20 is fixed on the cup 10, the lips 921 and 922 are crushed against the inner face 17 as they move apart. During this crushing, the air located in the central part of the second joint 92, in the space between the first lip 921 and the second lip 922, is expelled from this space such that the second joint 92 acts as a suction cup against the inner face 17. This suction cup effect contributes to having the second joint 92 adhere more strongly to the inner wall 17, which reinforces the sealing between the plate 20 and the plane wall 15.

An annular joint such as described hereinabove, having a transversal V-shaped cross-section in with two lips capable of acting as a suction cup when this annular joint is placed against a plane surface, can also be used to ensure the sealing of a reclosing system different to the system forming the object of the present invention, even not comprising a cover as described hereinbelow.

Advantageously, the assembly constituted by the body 2, the first joint 91, and the second joint 92 can be made by bi-injection of rigid polymer constituting the body 2 and a suppler elastomer constituting these joints 91 and 92.

The device 1 also comprises an arm 50, evident in FIGS. 1, 2, 3, 4, 9, and 10.

The arm 50 comprises a bar 54 which terminates at one end in a grip 56 and at the other end has a circular rod 53. The door 40 comprises a clip 43 which extends perpendicularly from the base 42 of the door 40 and is enclosed by the cylindrical wall 45. The rod 53 snap-locks in the clip 43 to form a pivot articulation according to an axis parallel to the axis of pivoting of the hinge formed by the web 41. The width of the bar 54 of the arm 50 (dimension according to the direction of this axis) is less than the width of the hole 30 of the plate 20, such that the bar 54 can freely pass through the hole 30. However, the width of the grip 56 is greater than the width of the hole 30.

The arm 50 is for example made of polymer, by moulding, which minimises its per-unit production cost.

The device 1 also comprises a cover 80, which is distinct from the body 2 and from the arm 50. The cover 80 has a form of an incurved shell, with a concave face 85 and a convex face 86. The cover 80 is bordered by a rim 87, and comprises tabs 88 which extend from the concave face 85 substantially perpendicularly to the latter. The cover 80 is positioned on the outer face 16 of the plane wall 15 of the cup 10 and is assembled on the plate 20 by means of the tabs 88 which snap-lock on to second tabs 28 of the plate 20 which extend from the upper face 26 of the plate 20 through the orifice 13. The snap-locking of the tabs 88 on the second tabs 28 is carried out at the level of the ends of these tabs which have a tooth form (FIG. 6). The tabs 88 are thus means for connecting the cover 80 to the plate 20.

As illustrated in FIG. 7, the first tabs 29 and the second tabs 28 are distributed alternately on the plate 20 around the hole 30, this distribution of the second tabs 28 ensuring that the snap-locking between the cover 80 and the plate 20 is distributed substantially uniformly over the entire periphery of the hole 30.

The tabs 88 are of a height less than that of the rim 87 such that when the tabs 88 and the second tabs 28 are snap-locked, the rim 87 presses on the upper face 16 of the cup 10, which locks and stabilises the assembly of the cover 80 and the body 20. Thus, a region (around the orifice 13) of the plane wall 15 of the cup 10 is sandwiched between the cover 80 and the plate 20.

The cover 80 has a U-shape. The centre of the cover 80 is thus a U-shaped hole, open on one side. This hole is delimited by a central sleeve 81 which extends from the convex face 86 beyond the concave face 85, substantially perpendicularly to the latter. The width of this central sleeve 81 is substantially equal to that of the hole 30 of the plate 20, and when the cover 80 and the plate 20 are assembled, the central sleeve 81 is located substantially in the alignment of the edge 25 of the hole 30, with the exception of the side on which the central sleeve 81 is open. This side is the one below which the web 41 is located. Thus, when the device 1 is reclosed, the arm 50 folds back above part of the door 40 and of the web 41, a portion of the plane wall 15 of the cup 10 then being located between the arm 50 and the door 40. The arm 50 is capable of folding back until the upper face of the arm 50 is in alignment with the convex face 86 of the cover 80 and fills the space at the centre of the cover 80 (as illustrated in FIG. 4) except the apex of the U. No part of the device 1 thus protrudes above the rim 12 of the cup 10, which ensures additional minimum bulk relative to a metal can of the prior art.

The cover 80 is made for example of polymer, by moulding, which minimises its per-unit production cost.

By way of variant, the snap-locking assembly of the plate 20 on the cup 10 and of the cover 80 onto the plate 20 can be done as described hereinbelow:

The first tabs 29 of the upper face 26 of the plate 20 (see description hereinabove) are enlarged in reciprocal direction until they join up to form a snap-lock bead 129, as illustrated in FIGS. 11 and 12. The second tabs 28 of the plate 20, which serve as snap-locking with the cover 80, are omitted. The snap-lock bead 129 extends circumferentially substantially right around the hole 30, with the exception of the side on which the central sleeve 81 of the cover 80 is opened. When the plate 20 is positioned on the plane wall 15 of the cup 10, the wall 29 is inserted into the orifice 13.

On its radially outermost face the snap-lock bead 129 comprises a first bead 295 which extends circumferentially all along this snap-lock bead 129. The positioning of the snap-lock bead 129 and the thickness (in a radial direction) of the first beads 295 is such that when the snap-lock bead 129 is rammed into the orifice 13, the snap-lock bead 129 deforms radially towards the centre of the orifice 13 when the inner edge 19 of the plane wall 15 pushes back the first beads 295. Thus, the plate 20 is fixed on the cup 10 by snap-locking via the snap-lock bead 129. The fact that the snap-lock bead 129 extends substantially all along the inner edge 19 allows solid assembly of the plate 20 on the cup 10.

The snap-lock bead 129 extends beyond the first beads 295, perpendicularly to the upper face 26, by an extension which comprises a second bead 298 which extends substantially over the entire length of this extension about the hole 30. This extension is located slightly more towards the hole 30 than the rest (base) of the snap-lock bead 129, such that it can be freely inserted into the orifice 13 (FIG. 13).

The cover 80 has tabs 88 which extend from its concave face 85 substantially perpendicularly to the latter. On their radially internal face the ends of the tabs 88 have a groove 888 which snap-locks with the second bead 298 when the cover 80 is fixed on the plate 20, so as to connect the cover 80 to the plate 20 (FIGS. 13 and 14). The tabs 88 are enlarged in reciprocal direction until they almost join up, which makes for a more rigid connection of the cover to the plate 20.

The functioning of the opening and closing of the device 1 is described hereinbelow, in reference to FIGS. 1, 2, 3 and 4.

Prior to initial opening of the device 1, the arm 50 is folded back as described hereinabove. The cover 80 is fitted with a tongue 100, evident in FIGS. 3 and 4 which illustrate the device 1 prior to its initial opening. The tongue 100 is located substantially in the extension of the convex face 86 of the cover 80 and covers the bar 54 of the arm 50, leaving the grip 56 free. The tongue 100 partially or fully covers the central sleeve 81 (that is, the central U-shaped region of the cover 80). The tongue 100 is connected to the cover 80 by a hooking system. This hooking system is deigned to be irreversibly broken during initial opening of the device 1. The hooking system comprises four links 104 distributed over the periphery of the tongue 100, each forming a bridge between the edge of the tongue 100 and the central sleeve 81 whereof this edge is separated by a narrow space.

The tongue 100 and the four links 104 are made for example of polymer, by moulding in a single piece with the cover 80, which minimise its per-unit production cost.

The tongue 100, the links 104 connecting the tongue and the cover 80, and the hooking system form a safety disc which, if intact, guarantees that the metal can has never been opened previously. The safety disc forms part of the blocking means of the arm 50 in a blocking position.

Other configurations of the safety disc are feasible.

To open the device 1 for the first time and consume the contents of the metal can, the arm 50 is lifted by means of the grip 56, at the same time breaking the links 104 and raising the tongue 100, now useless.

The arm 50 continues to be lifted. The bar 54 of the arm 50 comprises two pins 52 (evident in FIG. 9) which extend laterally from this bar 54. These pins 52 are designed to be lodged in grooves 82 of the body 80 which extend from the convex face 86 along the central sleeve 81, perpendicularly to this face. When the pins 52 are lodged in the grooves 82, the grip 56 of the arm 50 is supported against the convex face 86, and the door 40 is now blocked in the open position. Thus the grooves 82 and the pins 52 constitute blocking means of the arm 50 in the open position. Other blocking means of the arm 50 in the open position are feasible.

The width (dimension according to the direction of the axis of pivoting of the hinge formed by the web 41) of the grip 56 of the arm 50 is wider than the width of the central sleeve 81, which prevents the arm 50 from falling inside the metal can, and enables easy later closing of the metal can. The grooves 82 are located such that when the pins 52 are lodged in the grooves 82 the arm 50 is substantially perpendicular to the plate 20, which guarantees maximal opening of the door 40 (for example the grooves 82 are located at ⅓ the closest to the apex of the U (hole of the central sleeve 81). The rate of liquid through the sleeve 81 is thus optimal.

The hole 30 is oblong in shape, substantially identical to the form of the orifice 13 of the cup 10 and smaller in size. This form disengages, in front of the arm 50 (the region of the apex of the U-shaped central sleeve 81, the closest to the rim 12 of the cup) when the arm 50 is in the open position, an adequate part of the central sleeve 81 to allow the liquid contained in the metal can to flow at a convenient rate for consumption by a user.

To reclose the device 1, the pins 52 are disengaged from the grooves 82, and the arm 50 is folded back against the outer face 16 of the plane wall 15 of the cup 10, in the central region of the U. The cover 80 thus leaves the arm 50 disengaged. The central sleeve 81 comprises on its opposite faces (both sides of the U) two serrations 812 which slightly exceed the central sleeve 81 and extend in reciprocal direction. These serrations 812 are located in the vicinity of the convex face 86 (FIGS. 2 and 3), such that when the arm 50 is folded back as described hereinabove or prior to its initial opening (FIGS. 3 and 4), the bar 54, whereof the width is slightly less than that of the central sleeve 81, is located beyond (below) the serrations 812 and is snap-locked with the latter. The serrations 812 are for example located as close as possible to the open side of the U (above the web 41) so that the effort necessary for disengaging the arm 50 from the serrations 812 is maximal. The door 40 and the arm 50 are blocked in a leaktight blocking position (closed position) by means of the serrations 812 connected to the cover 80, which constitute blocking means of the arm 50 in a leaktight blocking position. These blocking means are also used prior to initial opening of the device 1 (see hereinabove), conjointly with the safety disc.

Other blocking means of the arm 50 in the closed position, connected to the cover 80, are feasible.

Alternatively, the blocking means can be located solely on the body 2 and the arm 50.

In the variant embodiment of the plate 20 and of the cover 80 illustrated in FIGS. 11 to 14 and described earlier, a snap-lock bead 129 extends circumferentially substantially all around the hole 30, with the exception of the side on which the central sleeve 81 of the cover 80 is open, to allow passage of the bar 54 of the arm 50 when the arm 50 is folded back (device in the closed position).

When the cover 80 is connected to the plate 20, the radially external face of the two branches of the U formed by the central sleeve 81 (FIG. 14) rests on the two faces 127 forming the ends of the snap-lock bead 129 (FIG. 12). Since these end faces 127 are located opposite one another, on each side of the central sleeve 81 and outside the latter, they contribute to holding the two branches of the U of the central sleeve 81 in position.

Thus, when the arm 50 snap-locks in the two serrations 812 of the central sleeve 81 the central sleeve withstands strong resistance to this snap-locking, as the snap-lock bead 129 prevents the two branches of the U of the central sleeve 81 which rest on the end faces 127 from moving apart. Locking of the device 1 according to the invention in the closed position is thus more effective.

The sealing of the device 1 in the closed position is guaranteed by these blocking means of the arm 50, and by the sealing means which make close contact between the cylindrical wall 45 and the inner face of the edge 25 of the plate 20, and the joints 91 and 92 (see hereinabove).

Other configurations of sealing means are feasible.

For example, the whole periphery 47 of the door 40 is constituted by a circumferential tongue made of supple material (for example elastomer) which is supported against the lower face 27 of the plate 20 which encloses the hole 30. The rest of the door 40 is made of stiffer polymer. In this configuration, the first joint 91 and the first groove 291 are omitted such that the supple periphery 47 is supported on a plane part of the inner face 27 to ensure a better sealing between the door 40 and the plate 20 (FIG. 15).

It is understood that because of the device 1 according to the invention a metal can be reopened and reclosed in a leaktight manner as often as wanted, which avoids loss of contents of the metal can, and allows consumption of these contents a number of times without loss of its properties between two consumption episodes.

The three elements constituting the device 1 (body 2, arm 50, and cover 80) are assembled by simple successive snap-locking: the plate 20 of the body 2 snap-locks onto the inner edge 19 of the orifice 13 of the cup 10. Then, once the door 40 of the body 2 is folded back towards the plate 20, the arm 50 snap-locks on the door 40 by passing the bar 54 of the arm 50 via the hole 30 of the plate 20. Once the arm 50 is folded back against the outer face 16 of the cup 10, the cover 80 snap-locks onto the plate 20, the arm 50 being located at the centre of the U-shape by the cover 80.

The device 1 can be easily made and assembled on a metal can, and at minimal cost.

Similarly, the device 1 can be made and assembled on a plane wall of any package to constitute a package according to the invention.

The invention claimed is:

1. A package of consumable product provided with a substantially plane wall and fitted with an orifice, comprising:

an opening and closing device comprising a body in a single piece, made of moulded material, fixed on said wall, said body comprising a plate fitted with a hole placed opposite said orifice, supported essentially on an inner face of said wall, and fixed on an edge of said orifice of the wall in a leaktight manner, and a door articulated to this plate opening towards the interior of the package and capable of blocking this hole in a leaktight manner, an arm connected to said door, said arm cooperating with blocking means in a first position such that it keeps said door in a leaktight blocking position, and releasing said door by pivoting towards the interior of said package when it is disengaged from said blocking means, and a cover distinct from said body and of said arm, and which is fitted with a safety disc which must be broken during initial opening of said door, such that if said safety disc is intact, it is guaranteed that the package has never been opened previously, said disc forming part of said blocking means;

wherein said cover comprises means for connecting with said plate, said cover, when it is connected to said plate, being located outside said package such that a region of said wall is sandwiched between said cover and said plate.

2. The package as claimed in claim 1, wherein said plate is fixed on the edge of said orifice of the wall by snap-locking.

3. The package as claimed in claim 2, wherein said plate comprises first tabs or a snap-lock bead which snap-lock on the edge of said orifice of the wall.

4. The package as claimed in claim 1, wherein said plate comprises a first joint on which said door is supported such that the junction a junction between said door and said plate is leaktight.

5. The package as claimed in claim 1, wherein said plate comprises a second joint on which said inner face is supported such that a junction between said wall and said plate is leaktight.

6. The package as claimed in claim 5, wherein said second joint is a joint in ring form comprising two lips capable of acting as a suction cup against said inner face.

7. The package as claimed in claim 1, wherein the means for connecting are tabs which extend from said cover and are capable of snap-locking with second tabs of the plate by means of teeth located at an end of said tabs and of said second tabs.

8. The package as claimed in claim 3, wherein the means for connecting are tabs which extend from said cover and are capable of snap-locking with said snap-lock bead by means of grooves located at an end of said tabs and a second bead located at the end of said snap-lock bead, said snap-lock bead also comprising first beads serving as snap-locking with said wall.

9. The package as claimed in claim 1, wherein said blocking means of said arm in a position where said door is in a leaktight blocking position are connected to said cover.

10. The package as claimed in claim 9 wherein said blocking means further comprise serrations connected to said cover and repositioning said arm and said door in a leaktight blocking position.

11. The package as claimed in claim 1, wherein said cover has a U-shape, and said arm is folded back against the wall, in a central region of said U, when it is in a blocking position.

12. The package as claimed in claim 11 wherein said safety disc comprises a tongue fully covering the U-shaped central region of said cover, and links connecting said tongue and said cover.

13. The package as claimed in claim 1, said arm further cooperating with said blocking means in a second position such that said door is in the open position.

14. The package as claimed in claim 1, wherein said door and said plate are articulated to each other by a supple moulded web forming a hinge.

* * * * *